US005752581A

United States Patent [19]

Orchowski

[11] Patent Number: 5,752,581

[45] Date of Patent: May 19, 1998

[54] LADDER STEP

[76] Inventor: Richard Orchowski, P.O. Box 173, Petersfield Manitoba, Canada, R0C 2L0

[21] Appl. No.: 644,977

[22] Filed: May 15, 1996

[30] Foreign Application Priority Data

Dec. 1, 1995 [CA] Canada ..... 2,154,392

[51] Int. Cl.[6] ..... E06C 1/00

[52] U.S. Cl. ..... 182/165; 182/22; 182/26; 182/180

[58] Field of Search ..... 182/22, 26, 165, 182/168, 180

[56] References Cited

U.S. PATENT DOCUMENTS

| | | | |
|---|---|---|---|
| 314,118 | 3/1885 | Foster | 182/165 |
| 487,469 | 12/1892 | Burgess | 182/22 X |
| 798,012 | 8/1905 | Clark | 182/22 |
| 992,051 | 5/1911 | Petrie | 182/26 |
| 1,110,700 | 9/1914 | LeVey | 182/180 X |
| 1,207,552 | 12/1916 | Hill | 182/22 |
| 1,312,725 | 8/1919 | Gagnier | 182/22 |
| 1,442,694 | 1/1923 | Martin | 182/23 X |

FOREIGN PATENT DOCUMENTS

| | | | |
|---|---|---|---|
| 211679 | 10/1960 | Austria | 182/180 |
| 690765 | 7/1964 | Canada | 182/26 |
| 548155 | 1/1923 | France | 182/168 |
| 4602 | 3/1892 | Sweden | 182/180 |

*Primary Examiner*—Alvin C. Chin-Shue
*Assistant Examiner*—Richard M. Smith
*Attorney, Agent, or Firm*—Adrian D. Battison; Murray E. Thrift

[57] ABSTRACT

An apparatus for supporting a ladder in inclined position without the necessity for engaging a separate support surface comprises an X-shaped support frame defined by a pair of posts crossing at a junction and interconnected by a beam at a position below the junction to hold the posts in the X-shape. At the top of each post is provided a U bracket which engages underneath a rung of the ladder. A cable passes between the beam and a selected rung of the ladder to hold the triangle against spreading. A second cable extends from the junction of the X frame to the rung carried in the U brackets at the top of the posts.

12 Claims, 3 Drawing Sheets

LADDER STEP

BACKGROUND OF THE INVENTION

This invention relates to an apparatus for supporting a ladder such that the ladder can be rendered self supporting without the necessity for leaning the ladder against a structure.

Step ladders are of course well known in which a length of ladder is attached to a support frame which is pivotally connected to the length of ladder so that the legs of the support frame can be pivoted out away from the ladder to form a triangle with a top of the ladder at the apex. However the step ladder is relatively unstable in view of the fact that the support frame has a narrow foot base and in addition the length of the step ladder is relatively limited.

Conventional ladders are readily available and are widely used but generally must be leaned against a rigid structure such as a building which again provides instability and in addition the building may not have suitable surfaces for resting the ladder against. For example a ladder leaned against a guttering may cause damage to the guttering. In the upper ends of the ladder are leaned against a flat surface, the upper ends may cause damage to the flat surface.

SUMMARY OF THE INVENTION

It is one object of the present invention, therefore, to provide an apparatus for supporting a ladder.

According to one aspect of the invention there is provided a apparatus for supporting a ladder having two legs and a plurality of interconnecting runs lying in a ladder plane, the apparatus comprising: a support frame having; two elongate posts having each having a foot at a lower end for engaging the ground and for standing upwardly therefrom; means interconnecting the posts so as to locate the two feet at transversely spaced positions for lying on a foot line parallel to the ladder plane with the spacing between the feet being greater than a width of the ladder and so as to locate top ends of the posts at transversely spaced positions lying in a top line substantially parallel to the foot line with the spacing between the top ends being less than the width of the ladder; each top end having a U-shaped receptacle thereon for receiving a rung of the ladder therein; flexible coupling means for extending between the support frame and the ladder at a position spaced downwardly of the rung so as to hold the support frame and the ladder as two sides of a triangle with the rung at the apex of the triangle; and connecting means for connecting between the support frame at the rung so as to hold the support frame against movement of the U-shaped receptacles away from the rung.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
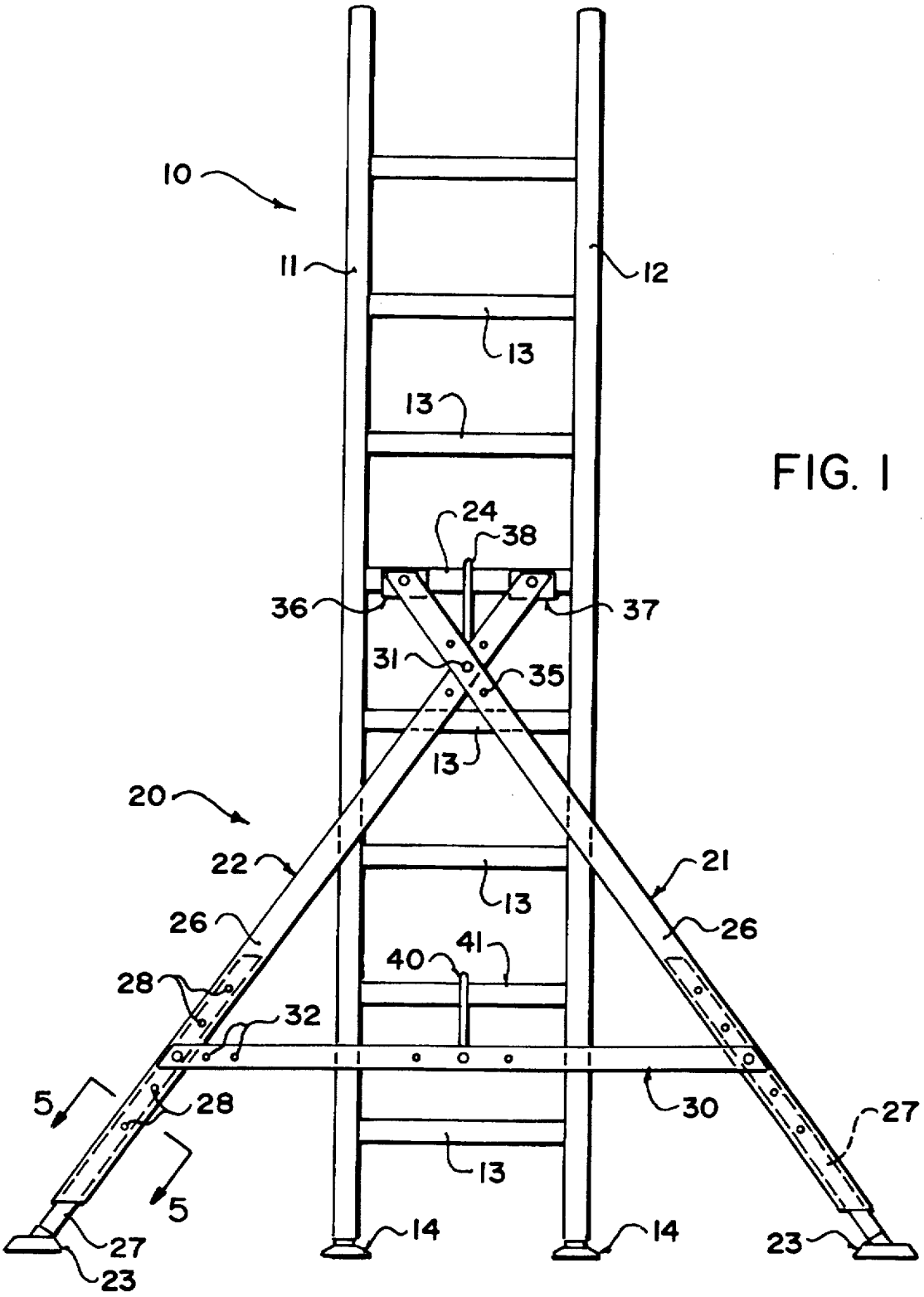
FIG. 1 is a rear elevational view of the apparatus according to the present invention attached to a conventional ladder.

A conventional ladder is indicated at 10 with a pair of legs 11 and 12 and a plurality of transverse rungs 13. The ladder has or may have feet 14 at the lower end for resting upon the ground.

The conventional ladder is supported in erected condition so that the legs extend upwardly from the ground at an inclined angle by a support apparatus generally indicated at 20. The support apparatus comprises a pair of posts 21 and 22 which are arranged in X configuration to form a frame. Each of the posts has a foot 23 at its lower end for engaging the ground so that the posts stand upwardly from the ground forming a triangle with the ladder with an apex of the triangle at a selected one 24 of the rungs.

Figure 5:
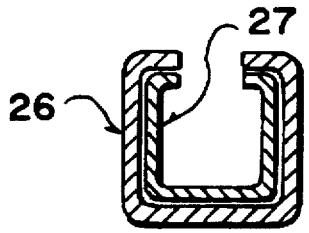
Figure 2:
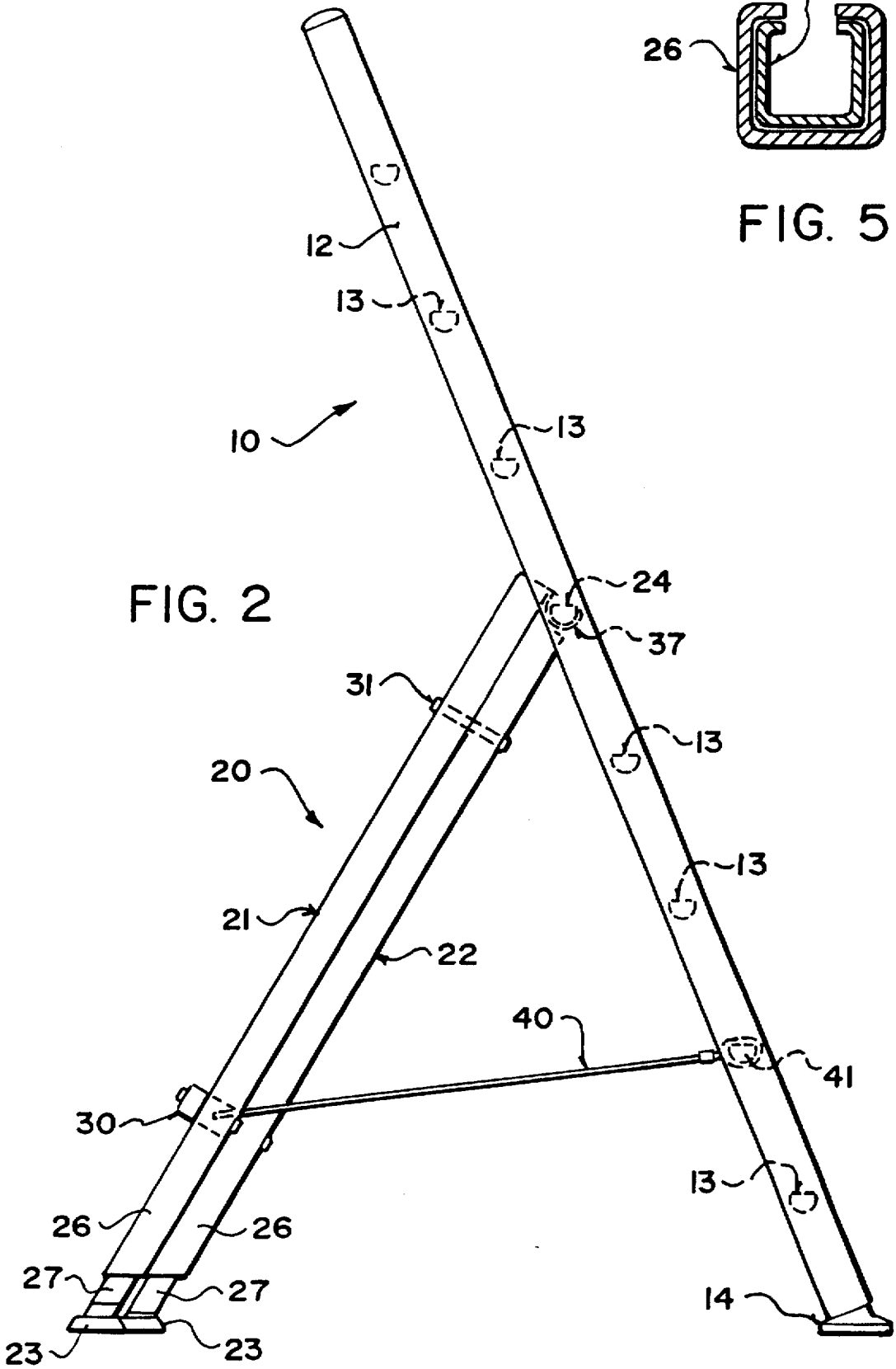
FIG. 2 is a side elevational view of the apparatus of FIG. 1.

Each of the legs as shown in the cross section in FIG. 5 comprises a channel member 26 and each of the legs is formed in two parts including an outer channel member and an inner channel member 27 so that the inner member can slide inside the outer member as shown in FIG. 1 and can be fastened in place by selection of one of a plurality of transverse holes 28. Thus the length of each of the posts can be adjusted. A brace member 30 extends across the two posts at a position spaced upwardly from the feet 23 and downwardly from a junction 31 between the two posts. The brace 30 includes a plurality of adjustment holes 32 allowing the brace to be connected to a selected one of the posts at spaced positions along the length of the brace so as to adjust the angle of the X of the support frame. The brace can be folded upwardly alongside the post 21 by releasing the coupling bolts at the post 22 for folding of the stand into a single elongate element for storage.

Figure 4:
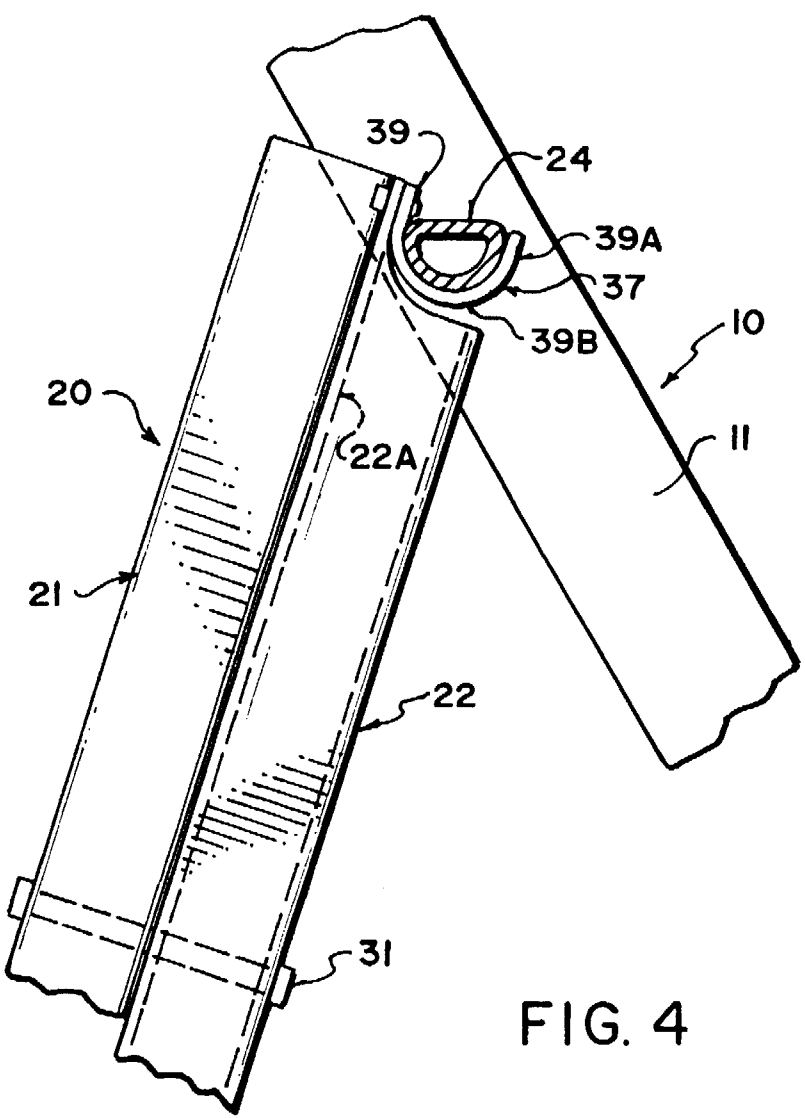
FIG. 4 is a similar cross sectional view of that of FIG. 3 showing the interconnection of the second post with the ladder.
Figure 3:
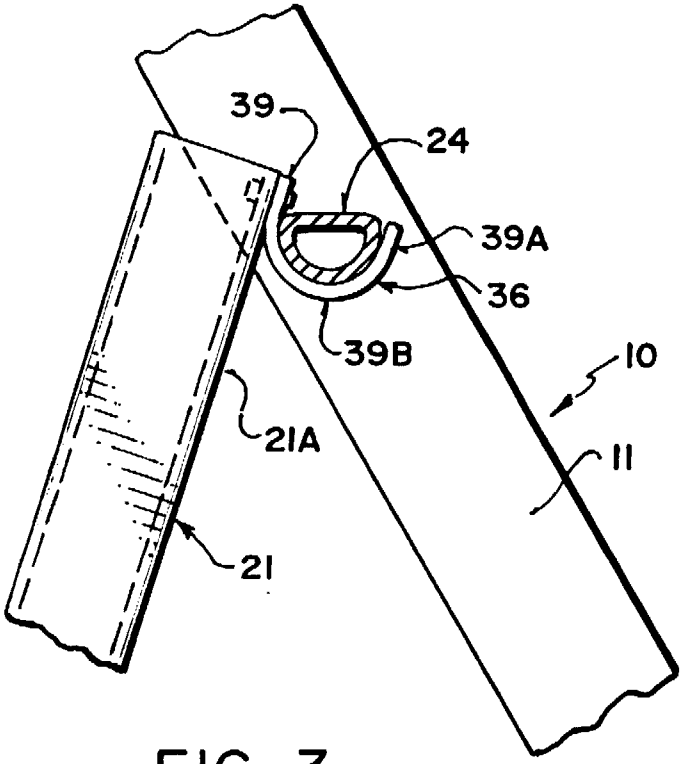
FIG. 3 is a vertical cross sectional view through the interconnection between the apparatus and the ladder on an enlarged scale.

The position of the junction 31 can be adjusted by selection of one or a plurality of holes 35 in the posts. Each of the posts has it at its upper end a respective one of a pair of U brackets 36, 37 best shown in FIGS. 3 and 4. Each of the U brackets engages the rung 24 and cups the rung 24. Thus each U bracket includes a pair of legs 39, 40 and a base 41 underneath the rung so that downward force is communicated from the rung into the U bracket. In view of the fact that the structure of the support frame is defined as an X-shape with the post 21 behind the post 22, the U bracket 36 on the post 21 is mounted on a forward face of a wall 21A of the post 21 while the U bracket 37 on the post 22 is mounted on a forward face of a rear wall 22A of the post 22 and the top part of the post 22 is cut away or recessed in front of the rear wall 22A. The U brackets are bolted to the walls 21 A and 22A so as to allow some pivotal movement about the axis of the pin which is at right angles to the rung of the ladder.

This alignment of the U brackets allows the support frame to be positioned behind the ladder but properly aligned so that the feet 23 lie on a foot line which is parallel to the rung 24 and parallel to the line of the feet 14 of the ladder.

A flexible cable 40 is connected from the beam 30 to a selected one of the rungs 41. This prevents the triangle defined by the support frame and the ladder from spreading.

A second flexible cable 38 extends from the junction 31 and particularly the bolt defining the junction upwardly and engages over the rung 24 so as to prevent upward movement of the rung 24 and therefore the ladder relative to the U brackets.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. Apparatus for supporting a ladder having two legs and a plurality of interconnecting rungs lying in a ladder plane, the apparatus comprising:

a support frame having;

two elongate posts each having a foot at a lower end for engaging the ground and for standing upwardly therefrom;

means interconnecting the posts so as to locate the two feet at transversely spaced positions for lying on a foot line parallel to the ladder plane with the spacing between the feet being greater than a width of the ladder and so as to locate top ends of the posts at transversely spaced positions lying in a top line substantially parallel to the foot line with the spacing between the top ends being less than the width of the ladder;

each top end having a U-shaped receptacle thereon for receiving a rung of the ladder therein;

flexible coupling means for extending between the support frame and the ladder at a position spaced downwardly of the rung so as to hold the support frame and the ladder as two sides of a triangle with the rung at the apex of the triangle;

and a cable for extending from the support frame upwardly to the rung for connecting from the support frame to the rung so as to hold the support frame against movement of the U-shaped receptacles away from the rung.

2. The apparatus according to claim 1 wherein the posts cross at a junction to form an X-shape and wherein the cable connects the posts at the junction of the X-shape.

3. The apparatus according to claim 2 wherein there is provided a cross beam interconnecting the posts which is horizontal and arranged below the junction and above the feet.

4. The apparatus according to claim 3 wherein the flexible coupling means comprises a cable for extending from the cross beam to a rung of the ladder below said rung.

5. The apparatus according to claim 2 wherein each of the U-shape receptacles comprises a U-shaped metal plate attached to a top of the respective post and wherein one of the U-shaped plates is offset forwardly of the respective post relative to the other of the U-shaped plates so as to accommodate the crossing of the posts at the junction.

6. Apparatus for supporting a ladder having two legs and a plurality of interconnecting rungs lying in a ladder plane, the apparatus comprising:

a support frame having;

two elongate posts each having a foot at a lower end for engaging the ground and for standing upwardly therefrom;

means interconnecting the posts so as to locate the two feet at transversely spaced positions for lying on a foot line parallel to the ladder plane with the spacing between the feet being greater than a width of the ladder and so as to locate top ends of the posts at transversely spaced positions lying in a top line substantially parallel to the foot line with the spacing between the top ends being less than the width of the ladder;

each top end having a U-shaped receptacle thereon for receiving a rung of the ladder therein;

flexible coupling means for extending between the support frame and the ladder at a position spaced downwardly of the rung so as to hold the support frame and the ladder as two sides of a triangle with the rung at the apex of the triangle;

connecting means for connecting from the support frame to the rung so as to hold the support frame against movement of the U-shaped receptacles away from the rung;

wherein the posts cross to form an X-shape and wherein each of the U-shape receptacles comprises a U-shaped metal plate attached to a top of the respective post and wherein one of the U-shaped plates is offset forwardly of the respective post relative to the other of the U-shaped plates so as to accommodate the crossing of the posts at the junction.

7. The apparatus according to claim 2 wherein each of the posts includes a plurality of holes therein at longitudinally spaced positions adjacent the junction for locating the junction at one of a plurality of spaced positions along the length of the post.

8. The apparatus according to claim 3 wherein the cross beam has a plurality of holes therein for connection to a respective one of the posts at one of a plurality of different positions along the length of the cross beam so as to adjust the angle of the posts relative to one another.

9. The apparatus according to claim 1 wherein each of the posts includes an upper portion and a lower portion slidable longitudinally relative to the upper portion such that the length of each of the posts can be adjusted.

10. Apparatus for supporting a ladder having two legs and a plurality of interconnecting rungs lying in a ladder plane, the apparatus comprising:

a support frame having;

two elongate posts each having a foot at a lower end for engaging the ground and for standing upwardly therefrom;

means interconnecting the posts so as to locate the two feet at transversely spaced positions for lying on a foot line parallel to the ladder plane with the spacing between the feet being greater than a width of the ladder and so as to locate top ends of the posts at transversely spaced positions lying in a top line substantially parallel to the foot line with the spacing between the top ends being less than the width of the ladder;

each top end having a U-shaped receptacle thereon for receiving a rung of the ladder therein;

flexible coupling means for extending between the support frame, and the ladder at a position spaced downwardly of(the rung so as to hold the support frame and the ladder as two sides of a triangle with the rung at the apex of the triangle;

connecting means for connecting from the support frame to the rung so as to hold the support frame against movement of the U-shaped receptacles away from the rung;

wherein the posts cross at a junction to form an X-shape and wherein each of the posts includes a plurality of holes therein at longitudinally spaced positions adjacent the junction for locating the junction at spaced positions along the length of the post.

11. The apparatus according to claim 10 wherein there is provided a cross beam which is horizontal and arranged below the junction and above the feet and wherein the cross beam has a plurality of holes therein for connection to a respective one of the posts at different positions along the length of the cross beam so as to adjust the angle of the posts relative to one another.

12. The apparatus according to claim 10 wherein each of the posts includes an upper portion and a lower portion slidable longitudinally relative to the upper portion such that the length of each of the posts can be adjusted.

* * * * *